US007600898B2

(12) United States Patent
Wunderer

(10) Patent No.: US 7,600,898 B2
(45) Date of Patent: Oct. 13, 2009

(54) ILLUMINATING DEVICE FOR LINEARLY ILLUMINATING A FLAT OBJECT

(75) Inventor: Bernd Wunderer, München (DE)

(73) Assignee: Giesecke & Devrient GmbH, Munich (DE)

( * ) Notice: Subject to any disclaimer, the term of this patent is extended or adjusted under 35 U.S.C. 154(b) by 138 days.

(21) Appl. No.: 10/570,898

(22) PCT Filed: Sep. 7, 2004

(86) PCT No.: PCT/EP2004/009972

§ 371 (c)(1),
(2), (4) Date: Dec. 22, 2006

(87) PCT Pub. No.: WO2005/027057

PCT Pub. Date: Mar. 24, 2005

(65) Prior Publication Data

US 2007/0109615 A1 May 17, 2007

(30) Foreign Application Priority Data

Sep. 10, 2003 (DE) ..... 103 41 805

(51) Int. Cl.
*F21V 7/00* (2006.01)

(52) U.S. Cl. ..... 362/346; 362/341; 362/298; 362/305

(58) Field of Classification Search ..... 362/297, 362/301, 305, 341, 346, 349, 298, 302
See application file for complete search history.

(56) References Cited

U.S. PATENT DOCUMENTS 4,034,217 A * 7/1977 Dumont ..... 362/297
4,174,533 A * 11/1979 Barthes et al. ..... 362/346
4,190,355 A 2/1980 Avery et al. ..... 355/71
4,396,834 A 8/1983 Appel et al. ..... 250/216
4,422,135 A * 12/1983 McCamy ..... 362/346
4,729,075 A * 3/1988 Brass ..... 362/217
4,747,027 A * 5/1988 Rieger ..... 362/217
5,369,528 A * 11/1994 Rabl et al. ..... 359/855
5,477,440 A 12/1995 Brun
5,584,572 A * 12/1996 Ishikawa ..... 362/346
6,095,656 A * 8/2000 Shimura et al. ..... 362/97
6,583,535 B1 * 6/2003 Lumpp ..... 313/634
6,717,161 B1 * 4/2004 Cekic et al. ..... 250/504 R

FOREIGN PATENT DOCUMENTS

DE 0 341 996 A2 11/1989
DE 689 09 668 T2 4/1994
DE 100 00 029 A1 7/2001
DE 10000029 A1 * 7/2001
WO WO 01/50081 A2 7/2001

* cited by examiner

*Primary Examiner*—Jacob Y Choi
*Assistant Examiner*—Leah S Lovell
(74) *Attorney, Agent, or Firm*—Bacon & Thomas, PLLC

(57) ABSTRACT

An illuminating device for linearly illuminating a flat object, in particular a bank note, includes at least one or a plurality of linearly disposed light sources, a mirror arrangement serving as a reflector that extends in parallel to the linearly disposed light sources, with an optical axis perpendicular thereto. The mirror arrangement includes plane mirrors, with at least one first mirror having a structure, which images the light source to form at least one linear image in parallel to the mirror arrangement. At least one second mirror images the at least one linear image to form a linear illumination in parallel to the mirror arrangement on the optical axis or in the proximity of the optical axis.

18 Claims, 6 Drawing Sheets

ILLUMINATING DEVICE FOR LINEARLY ILLUMINATING A FLAT OBJECT

FIELD OF THE INVENTION

The present invention relates to an illuminating device for linearly illuminating a flat object, in particular a bank note.

BACKGROUND

Illuminating devices for linearly illuminating a flat object, in particular a bank note, have to fulfill a plurality of conditions in order to be able to meet the demands made on them. These demands comprise, among other things, an illumination as homogeneous as possible with a high light intensity and at the same time low amount of energy used in order to avoid unnecessary heat build-up. In addition, for example for the use in bank note processing machines, it is decisive that the illumination of the object to be measured, i.e. of the bank note that is transported past the illuminating device with a high speed, takes place in a fashion such that there is no or only a low dependence on the distance of the object to be measured to the illuminating device, since the distance may vary due to the transportation of the bank note.

Illuminating devices for linearly illuminating a flat object, in particular a bank note, meeting these requirements are known. Such an illuminating device is known for example from DE 100 00 029 A1. This illuminating device contains a mirror arrangement, which in cross section is disposed symmetrically to an optical axis and consists of several mirror segments directly adjacent to each other.

But it has turned out that the manufacturing of the mirror segments is elaborate, since the mirror segments have a non-linear curve shape, e.g. circular, elliptic, hyperbola-shaped etc. This curve shape makes great demands on the manufacturing of the mirror segments, which usually is effected by milling the mirror segments out of a full metallic material, e.g. aluminum, and a subsequent polishing. Moreover, the assembling of the curved mirror segments as to form the illuminating device is difficult, since the non-linear mirror segments have to be fitted together in an exactly adjusted fashion in order to obtain the desired illumination properties.

SUMMARY

Therefore, the invention is based on the problem to specify an illuminating device for linearly illuminating a flat object, in particular a bank note, that on the one hand can fulfill the requirements with respect to the illumination and on the other hand can be manufactured with low effort.

This problem is solved according to the invention by the features described herein.

The invention starts out from an illuminating device for linearly illuminating a flat object, in particular a bank note, having at least one or a plurality of linearly disposed light sources, a mirror arrangement serving as a reflector which extends in parallel to the linearly disposed light sources, with an optical axis extending perpendicular thereto, wherein the mirror arrangement consists of plane mirrors, at least one first mirror has a structure that images the light source to form at least one linear image in parallel to the mirror arrangement, and wherein at least one second mirror images the at least one linear image to form a linear illumination in parallel to the mirror arrangement on the optical axis or in the proximity of the optical axis.

The invention in particular has the advantage, that assembling the mirror arrangement is especially easy because of the use of plane mirrors. The plane mirrors can also be manufactured with low effort.

BRIEF DESCRIPTION OF THE DRAWINGS

Further advantages of the present invention appear from the dependent claims and the following description of embodiments with reference to Figures.

DETAILED DESCRIPTION

Figure 1:
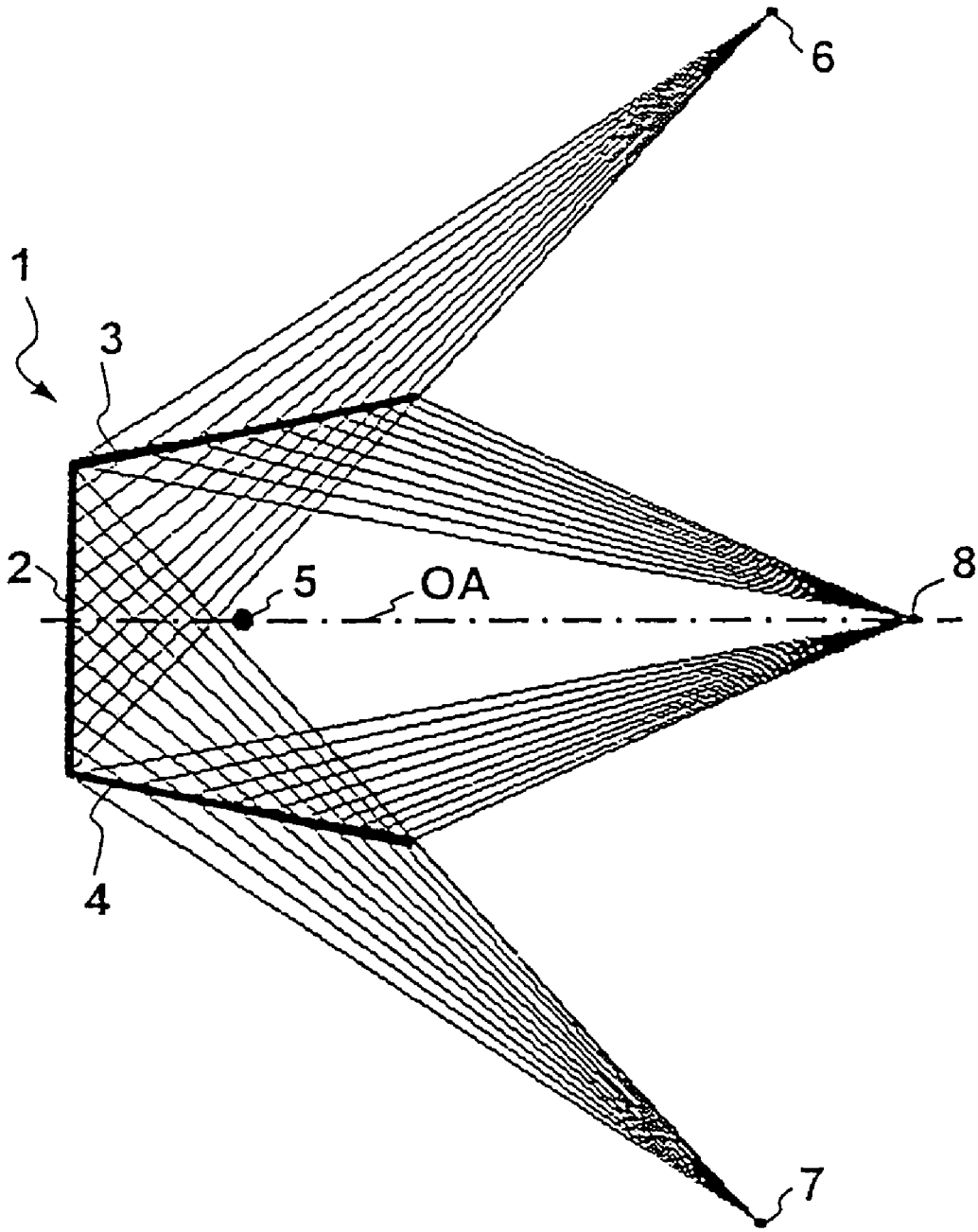
FIG. 1 shows a representation of the beam path of an illuminating device according to the invention.

FIG. 1 shows a representation of a beam path of an illuminating device 1 according to the invention.

The illuminating device 1 has a mirror arrangement 2, 3, 4, with a first plane mirror 2 having structures, which is disposed perpendicular to an optical axis OA. The first mirror 2 is adjoined by second plane mirrors 3 and 4. A light source 5 is disposed on the optical axis OA. The light source 5 is imaged by the first mirror 2 to form two image points 6 and 7, which are disposed mirror-symmetrically to the optical axis. This symmetry is advantageous, but not absolutely necessary. The second mirrors 3 and 4 are disposed in the beam path of the first mirror 2 in such a way that they image the image points 6 and 7 to form an illuminated point 8 on the optical axis.

The illuminating device 1 represented in the plane can be used to linearly illuminate a flat object. For this purpose the mirror arrangement 2, 3, 4 is expanded vertically out of the plane of the representation or vertically to the optical axis OA, until a linear illumination with the desired length is the result. In this case the light source 5 is imaged by the first mirror 2 to form linear images 6 and 7 in parallel to the mirror arrangement, which are imaged by the second mirrors 3 and 4 to form the desired linear illumination 8, the linear illumination 8 extending in parallel to the mirror arrangement 2, 3, 4 or perpendicular to the optical axis OA. Likewise, it is possible to produce an axially symmetric mirror arrangement by rotating the represented mirrors 2, 3, 4 around the optical axis OA, e.g. for a punctual or circular illumination 8.

Figure 2:
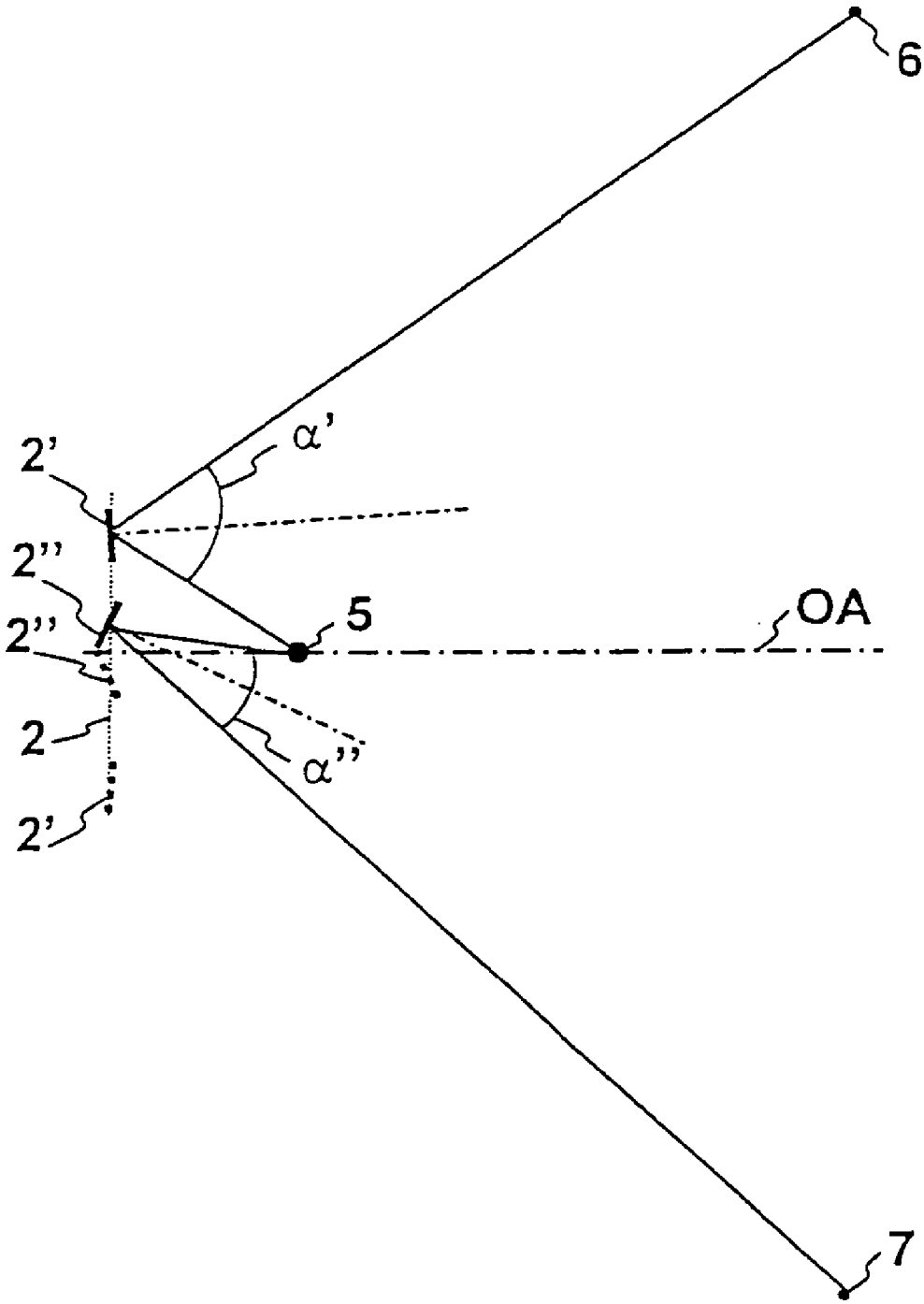
FIG. 2 shows a representation of a beam path of a part of the illuminating device according to FIG. 1.

FIG. 2 is a representation of a beam path of a part of the illuminating device 1, namely of the first mirror 2. From FIG. 2 is apparent, how the structure of the first mirror 2 is designed as to be able to effect the above-described imaging. The structure of the first mirror 2 is formed by segments, into which the surface of the mirror 2 is divided. A division in 20 to 100 segments has proved to be advantageous. In FIG. 2 only two segments 2' and 2" are shown by way of example. The segment 2' serves for imaging the light source 5 to form the first image point 6, the segment 2" serves for imaging the light source 5 to form the second image point 7. In contrast to the plane or surface of the first mirror 2 the segments have an inclination, which in each case is perpendicular to the bisecting line of the angles $\alpha'$ or $\alpha''$, which each are enclosed by the light beam incident from the light source 5 and the light beam emitting toward the image points 6 and 7. In this way it is possible to determine the inclination for all given segments of the first mirror 2, so that the structure of the first mirror 2 has the above described imaging properties. It is sufficient to execute the described determination of the inclination of the segments for one half of the first mirror 2, since the two halves of the first mirror 2 determined by the optical axis OA are identical and are disposed mirror-symmetrically to the optical axis OA.

In generalization of the image anticipated as punctual in the above example any distribution of intensity around the image points 6 and 7 can be preset and with optimizing processes the inclination of the mirror segments, which produce this distribution, can be determined.

Figure 3:
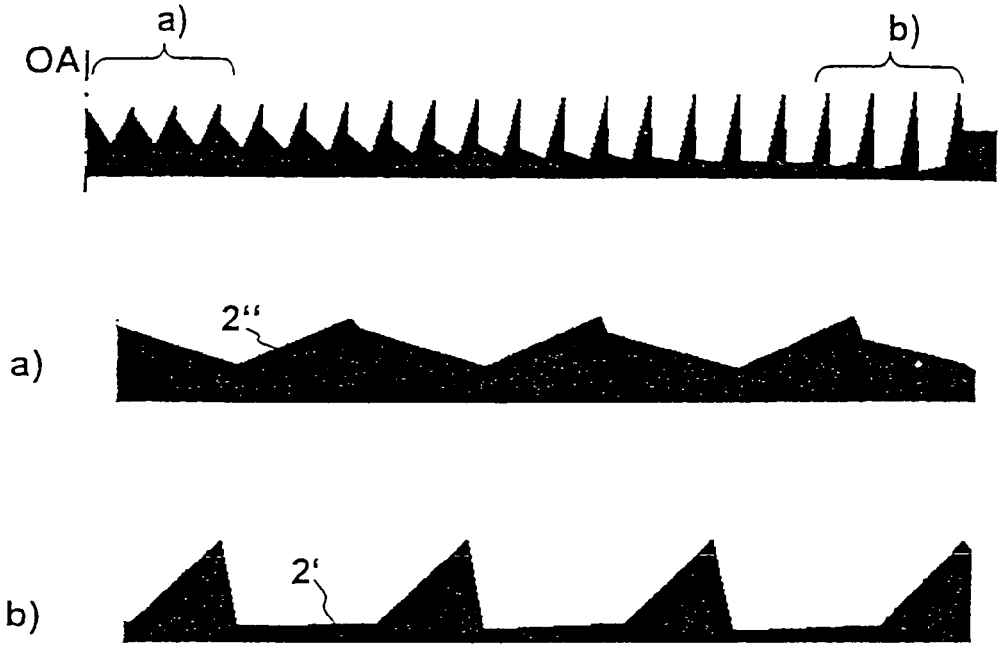
FIG. 3 shows a schematic representation of a mirror of the illuminating device according to FIGS. 1 and 2.

FIG. 3 shows a schematic representation of the first mirror 2 of the illuminating device 1. In FIG. 3 only the half of the mirror 2 lying below the optical axis OA is shown, since—as indicated above—the upper half of the first mirror 2 is the result of the reflection of the lower half at the optical axis OA. The structure of the first minor 2 represented in the upper part of the Figure for the purpose of better perceptibility is shown with vertically exaggerated segments. The areas marked with a) and b) are displayed in the lower parts of FIG. 3 in their exact height ratio. Specifically, the areas shown in areas a) and b) represent different segments of the mirror, wherein a first segment is formed as a peak and valley configuration having a first height ratio, and a second segment is formed as a peak and valley configuration having a second height ratio, different from the first height ratio of the first segment. Section a) shows an area of the middle of the first minor 2, whereas section b) represents an area of the edge of the first mirror 2. By way of illustration, additionally, the segments 2' and 2" as represented in FIG. 2 are shown in FIG. 3.

Figure 4:
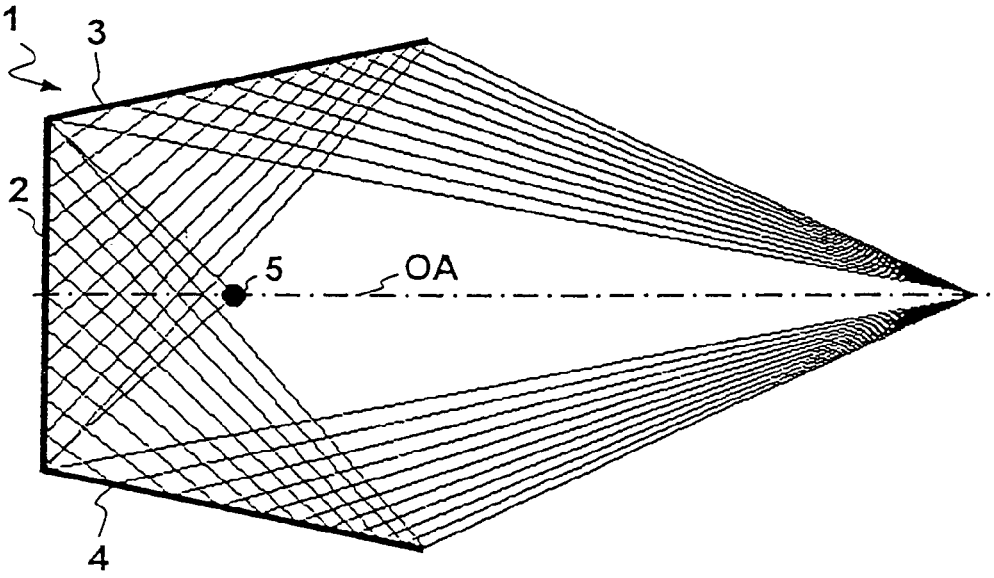
FIG. 4 shows a schematic representation of a first embodiment of an illuminating device according to the invention.

FIG. 4 shows a schematic representation of a first embodiment of an illuminating device 1, of a first plane mirror 2 and second plane mirrors 3 and 4 and a light source 5 disposed on the optical axis. The plane mirror 2 has the structures as described above in connection with FIGS. 2 and 3. The second plane mirrors 3 and 4 are formed by planar mirrors. As shown in FIG. 4, the light source 5 has an aperture of about 90°, within which it emits light onto the first plane mirror 2. The structure, i.e. the segments of the first plane mirror 2 are arranged, as in FIG. 3, such that one segment effects an imaging as to form the first image point (see FIG. 1, image point 6), whereas the next segment effects an imaging as to form the second image point (see FIG. 2, image point 7). The next segment then again effects an imaging as to form the first image point etc. In this way each part of the surface of the first mirror 2 alternatingly contributes to one of the image points 6 or 7.

Figure 5:
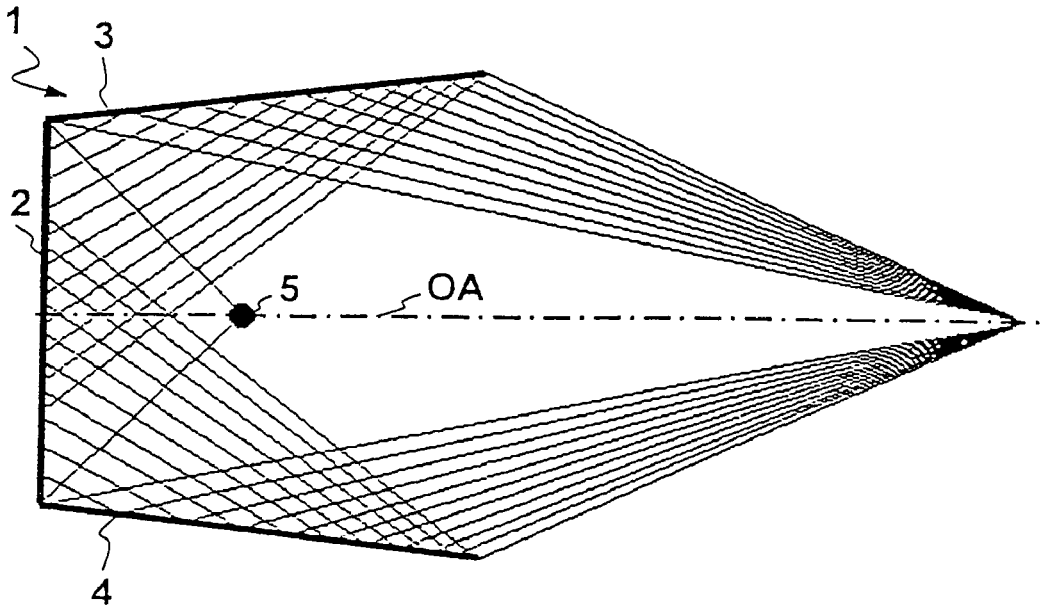
FIG. 5 shows a schematic representation of a second embodiment of an illuminating device according to the invention.

In FIG. 5 a schematic representation of a second embodiment of an illuminating device 1 is shown. The design of the illuminating device 1 substantially corresponds to the design of the illuminating device 1 of FIG. 4. The difference lies in that the design of the structure of the first mirror 2 is altered. The segments forming the structure only for a middle area of the first mirror 2 located around the optical axis are disposed alternately, so that only this middle area contributes to the two image points 6 and 7, whereas the outer area of the first mirror located above the optical axis OA contributes only to the first image point 6 and the outer area of the first mirror 2 located below the optical axis OA only contributes to the second image point 7. This is effected by the segments lying in the outer areas all being directed to the image point that lies on the same side of the optical axis OA.

Figure 6:
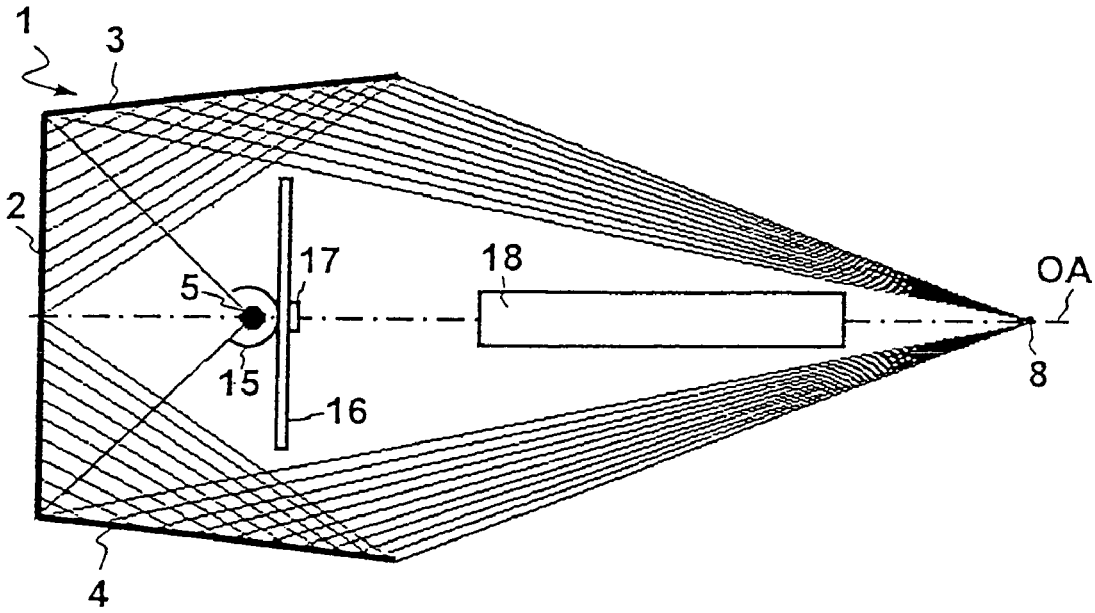
FIG. 6 shows a schematic representation of a third embodiment of an illuminating device according to the invention.

FIG. 6 shows a schematic representation of a third embodiment of an illuminating device 1. The design of the illuminating device 1 represented in FIG. 6 substantially corresponds to the illuminating device 1 represented in FIG. 4. The difference lies in that the structure of the first mirror 2 now is disposed in such a way that the area of the first mirror 2 located above the optical axis OA exclusively images the first image point 6, whereas the area of the first mirror 2 located below the optical axis OA exclusively contributes to the second image point 7. For this purpose the segments of the first mirror 2 are aligned in such a way as already described above in connection with the outer areas of the first mirror 2 of FIG. 5.

In FIG. 6 additionally a sensor 17 is represented, which is used for capturing the illuminated point 8 (or the illuminated line) of an object to be measured. The sensor 17 is disposed in the illuminating device 1 in such a way that it is located in an area not exposed to the beam path. For improving the imaging of the object to be measured and tested an imaging system 18 can be used, in particular a lens, e.g. a gradient lens, which effects a 1:1 imaging. The imaging system 18 is also disposed in such a way that it is located in an area of the illuminating device 1 not exposed to the beam path. Furthermore, it is possible to provide a screen 16 as to avoid the occurrence of scattered light at the place of the sensor 17. The screen 16 likewise can be formed by a printed circuit board or can have a printed circuit board, which carries the sensor 17 and/or the light source 5. For improving the luminous efficiency of the light source 5 in addition it can be provided that around the light source a reflector 15 is disposed.

Figure 7:
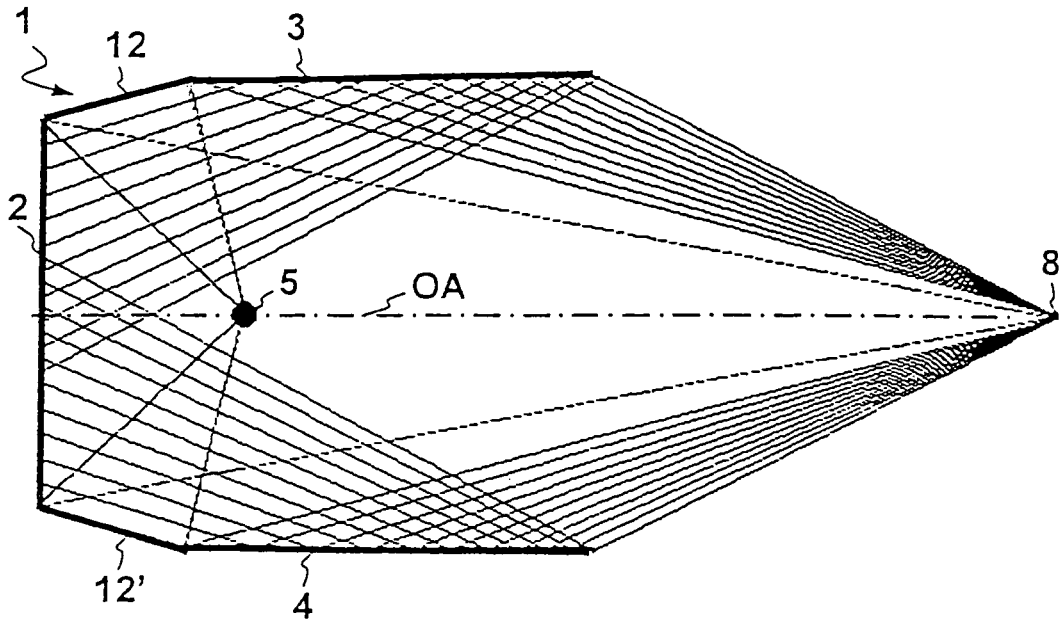
FIG. 7 shows a schematic representation of a fourth embodiment of an illuminating device according to the invention.

FIG. 7 shows a schematic representation of a fourth embodiment of an illuminating device 1. The illuminating device 1 is formed by a first plane mirror 2 having a structure and second plane mirrors 3 and 4, the structure of which corresponds to the above described embodiments. Additionally, however, between the first mirror 2 and the second mirrors 3 and 4 there are further mirrors 12 and 12'. The further mirrors 12 and 12" enclose an angle with the optical axis OA that in each case is smaller than 90°. The structure of the further mirrors 12 and 12' is aligned such that the light source 5 is directly imaged to form the illuminated point 8. In this way it is possible to open the aperture of the light source 5 up to 180° and thus to optimally use light sources with a large angle of radiation such as high-power light emitting diodes. For the above-described use of the illuminating device 1 for linearly illuminating, with the help of the further mirrors 12 and 12' the light of the light source 5 is imaged to form a linear illumination in parallel to the mirror arrangement 2, 3, 4, 12, 12' on the optical axis.

Figure 8:
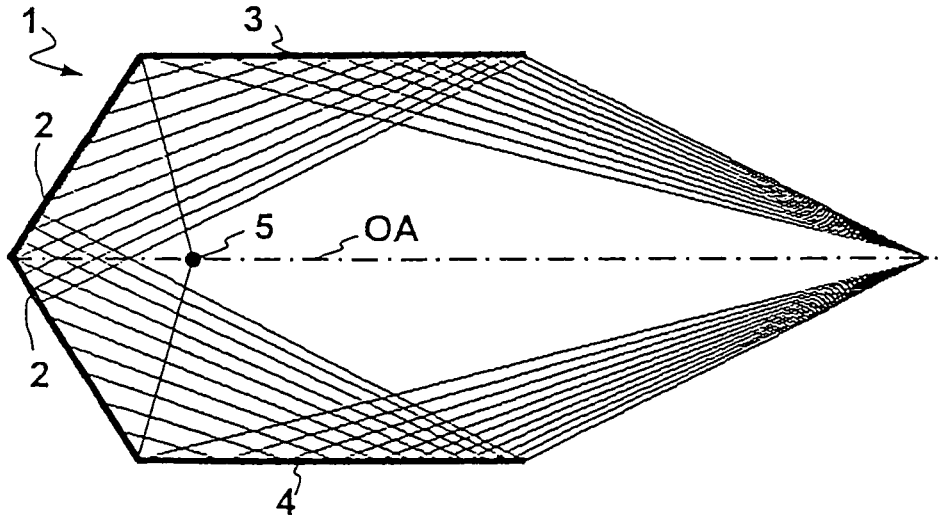
FIG. 8 shows a schematic representation of a fifth embodiment of an illuminating device according to the invention.

FIG. 8 shows a schematic representation of a fifth embodiment of an illuminating device 1. In the fifth embodiment the mirrors 2, 3 and 4 likewise substantially correspond to the above described mirrors with the same numbering, the first mirror 2 consisting of two parts, which touch each other at the optical axis OA and enclose an angle of less than 180°.

Figure 9:
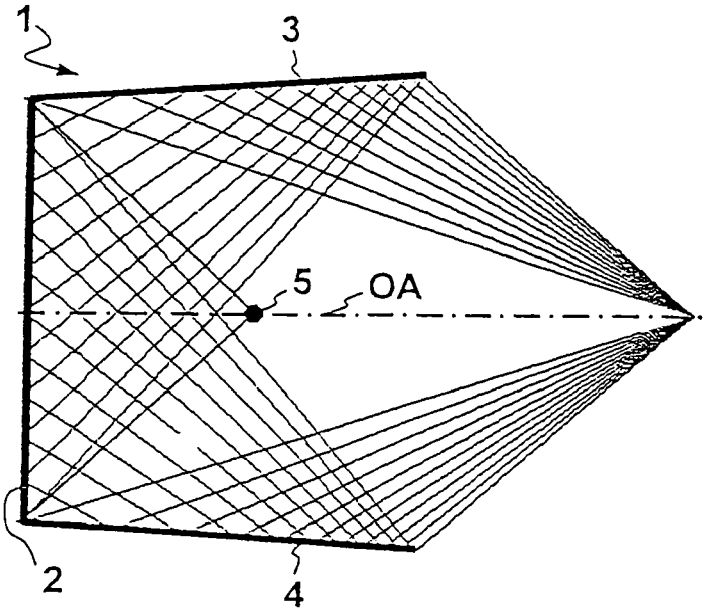
FIG. 9 shows a schematic representation of the first embodiment of an illuminating device according to the invention with altered aspect ratio.

FIG. 9 shows a schematic representation of the first embodiment of an illuminating device 1 with altered imaging properties. By a shift of the position of the first image points 6 and 7 in the direction of the light source 5 the distance to the illuminated object to be measured is shortened, as a result of which the light beams illuminate the object to be measured with a flatter angle. In the same way in principle it is possible to adjust the imaging properties of the illuminating device 1 as to meet the respective demands.

Figure 10:
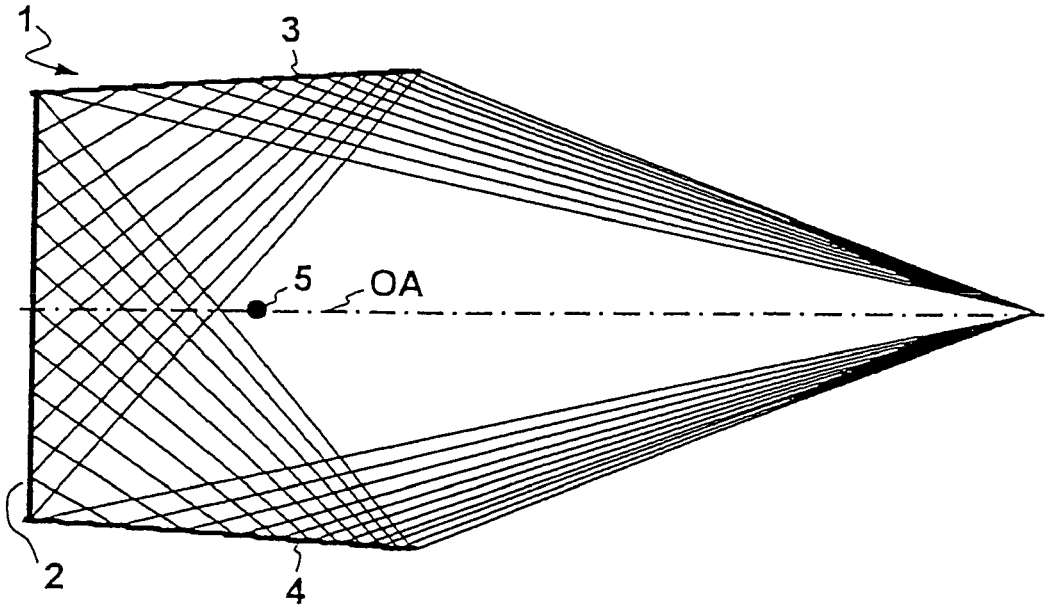
FIG. 10 shows a schematic representation of a sixth embodiment of an illuminating device according to the invention.

FIG. 10 shows a schematic representation of a sixth embodiment of an illuminating device 1. The illuminating device 1 has a first mirror 2, such as already described for FIGS. 4 to 7. In the present case it is exactly the same as in FIG. 9. Second mirrors 3 and 4 (in the same position and size as in FIG. 9) in this embodiment are also formed by plane mirrors having structure, which image the first and second image point of the light source as to form the illuminated point 8. This imaging, however, is no longer a mere deflection, but enlarges the image points, which in turn enlarges the distance of the illuminated point 8 to the light source. Accordingly, with linear illumination the linear images are imaged onto the optical axis OA.

The manufacturing of the plane second mirrors 3 and 4 does not require any further explanation, if these, as described above, are formed as planar mirrors.

If the plane second mirrors 3 and 4 have a structure as the first mirror 2 or the further mirrors 12 and 12', as described above, a manufacturing by extrusion or injection molding is expedient and especially advantageous. If the mirrors 2, 3, 4, 12, 12' having structure are manufactured by extrusion, they can be produced in any length.

If the mirrors having structure are manufactured by injection molding, with a preset length of the manufactured mirrors, any lengths for the illuminating device 1 can be obtained by fitting together a plurality of these mirrors with preset length. A modular structure can also be provided, i.e. a corresponding mirror arrangement 2, 3, 4, 12, 12' is provided with the described light source 5 as to form a module. These modules are fitted together as to obtain the desired length of the illuminating device 1 or of the linear illumination 8.

A further possibility to reduce the size of the tools required for the extrusion or injection molding is to produce only one half of the first mirror 2. This is possible, since—as described above—the first mirror 2 is mirror-symmetrically to the optical axis OA. Thus the first mirror 2 can be formed of two identical parts, which are put together at the optical axis OA, the identical parts being disposed in a mirror-inverted fashion to the optical axis OA.

Preferably, it is provided, that the first mirror 2 on its surface facing the light source 5, i.e. on the structure, is mirror-coated. But it is also possible to produce the first mirror 2 of a material transparent for the light of the light source 5 and to provide the surface of the first mirror facing away from the light source 5 with the structure and to mirror-coat it. In this case the surface facing the light source 5 has to be planar and it should be antireflection-coated. The transparent material of the first mirror by refraction at the plane surface effects a reduction of the size of the angles of incidence and an increase of the size of the angles of reflection, so that the angles of the structure and with that the depth of the structure become smaller.

A further possibility of manufacturing is to dispose mirror 2 together with the deflection mirrors 3 and 4 on the surface of a solid body made of transparent plastic. With flat angles of incidence onto the mirrors 3 and 4 (such as in FIGS. 4 to 7) for these a mirror coating is not necessary, since there is total reflection.

Until now only the use of mirrors was described, which due to their more compact structure are preferred for the present invention. But is also possible to design this structure as to obtain a lens effect. In this case it is obvious that the position of the light source 5 has to be shifted to the side of the first structure 2 facing away from the object to be illuminated, which then is used as a lens.

As a light source 5 in principle all known light sources such as light emitting diodes, incandescent lamps or gas discharge lamps can be used. The light sources can be formed in a punctual fashion, but they can also have a linear extension and be disposed in parallel to the mirror structure 2, 3, 4. In the case of the above described modular structure a corresponding light source 5 can be provided in each of the modules.

It is also possible to produce a plurality of illuminated points or linear illuminations at the illuminated point 8 or the linear illumination 8. This can be effected by disposing two additional light sources 5 for example above and below the optical axis. Likewise it is possible, in the case a single light source 5 is used, to provide more than one illuminated point 8 or one linear illumination by a respective design of the structure of the first mirror 2. If a plurality of light sources is used it can also be provided to use light sources of different wavelengths.

The sensor arrangement described in connection with FIG. 6 obviously can be used together with all described embodiments of the illuminating device according to the invention. The sensor arrangement can be component of a bank note processing machine, in which bank notes are transported with a high speed past the illuminated point 8 or the linear illumination, in order to test them with the help of the signals produced by the sensor arrangement. The sensor arrangement in this case captures light remitted by the object to be measured. But the sensor arrangement can also be disposed such that it captures light transmitted through the object to be measured.

The invention claimed is:

1. An illuminating device for linearly illuminating a flat object such as a bank note, comprising at least one or a plurality of linearly disposed light sources, a mirror arrangement serving as a reflector, which extends in parallel to the linearly disposed light sources, with an optical axis (OA) perpendicular thereto, said mirror arrangement comprising plane mirrors, including a first mirror having a structure which images the light source to form two linear images in parallel to the minor arrangement which are disposed mirror-symmetrically to the optical axis (OA), and two second mirrors imaging the two linear images to form a linear illumination in parallel to the mirror arrangement on the optical axis (OA) or in the proximity of the optical axis (OA);

wherein the first mirror is formed as a single flat plane mirror and the structure that images the light source is formed in segments into which a surface of the first plane mirror is divided; and wherein at least one first segment is formed as a peak and valley configuration having a first height ratio, and at least one second segment is formed as a peak and valley configuration having a second height ratio, different from the first height ratio.

2. The illuminating device according to claim 1, wherein the structure of the first mirror is formed by segments, wherein the segments in relation to the plane of the first mirror each have an inclination, said inclination in each case being perpendicular to a bisecting line of an angle ($\alpha'$, $\alpha''$), that in each case is enclosed by the angle of incidence of the light source and the respective angle of reflection of the at least one image.

3. The illuminating device according to claim 1, wherein the structure of the first mirror is formed by segments, wherein the segments in relation to the plane of the first mirror each have an inclination, said inclination resulting from the optimization of a preset illumination distribution in at least one image.

4. The illuminating device according to claim 1, wherein the first mirror is disposed perpendicular to the optical axis (OA).

5. The illuminating device according to claim 1, wherein the structure of the first mirror on the left of the optical axis (OA) only images points on the left of the optical axis (OA), and the structure of the first minor on the right of the optical axis (OA) only images points on the right of the optical axis (OA).

6. The illuminating device according to claim 1, wherein the structure of the first mirror on the left of the optical axis (OA) images all points on the left of the optical axis (OA) and all or parts of the points on the right of the optical axis (OA), and that the structure of the first mirror on the right of the optical axis (OA) images all points on the right of the optical axis (OA) and all or parts of the points on the left of the optical axis (OA).

7. The illuminating device according to claim 1, wherein the first mirror on each side of the optical axis (OA) is elongated by at least one further mirror having a structure which has an angle to the optical axis (OA) that is smaller than 90°, and that the structure of the further mirrors images the light source to form a linear illumination in parallel to the mirror arrangement on the optical axis (OA) or in the proximity of the optical axis (OA).

8. The illuminating device according to claim 1, wherein the second mirrors are planar mirrors.

9. The illuminating device according to claim 1, wherein the second mirrors have a structure which images the two linear images to form a linear illumination in parallel to the mirror arrangement on the optical axis (OA) or in the proximity of the optical axis (OA).

10. The illuminating device according to claim 1, wherein the one or plurality of linearly disposed light sources are formed by light emitting diodes, incandescent lamps or gas discharge lamps.

11. The illuminating device according to claim 1, wherein the first mirror is made by extrusion or injection molding.

12. The illuminating device according to claim 1, wherein the surface of the first mirror facing the light source carries the structure and is mirror-coated.

13. The illuminating device according to claim 1, wherein a surface of the first mirror facing away from the light source comprises said structure and is mirror-coated, and a surface of the first mirror facing the light source is planar and non-reflecting.

14. The illuminating device according to claim 1, wherein the mirror arrangement has a preset length, and wherein, for obtaining a desired length of the illuminating device, a plurality of mirror arrangements with preset length are fitted together.

15. The illuminating device according to claim 14, wherein each mirror arrangement has a light source.

16. A sensor arrangement for linearly testing a flat object such as a bank note, comprising an illuminating device according to claim 1.

17. The sensor arrangement according to claim 16, wherein a sensor is disposed in the area not exposed to the beam path between the light source and the linear illumination.

18. The sensor arrangement according to claim 17, wherein an imaging system is disposed in the area not exposed to the beam path between the sensor and the linear illumination.

* * * * *

UNITED STATES PATENT AND TRADEMARK OFFICE

CERTIFICATE OF CORRECTION

PATENT NO. : 7,600,898 B2
APPLICATION NO. : 10/570898
DATED : October 13, 2009
INVENTOR(S) : Bernd Wunderer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 238 days.

Signed and Sealed this

Fifth Day of October, 2010

David J. Kappos

David J. Kappos
*Director of the United States Patent and Trademark Office*